US005125638A

United States Patent [19]

Ballestrazzi et al.

[11] Patent Number: 5,125,638

[45] Date of Patent: Jun. 30, 1992

[54] CENTRALLY CONTROLLED AUTOMATIC DEVICE FOR FEEDING SINGLE SHEETS OR THE LIKE WITHIN A PACKAGING MACHINE

[75] Inventors: Aris Ballestrazzi; Lamberto Tassi, Savignano Sul Panaro, both of Italy

[73] Assignee: Sitma S.p.A., Spilamberto, Italy

[21] Appl. No.: 664,542

[22] Filed: Mar. 1, 1991

[30] Foreign Application Priority Data

Mar. 9, 1990 [IT] Italy ..... 19635 A/90

[51] Int. Cl.[5] ..... B65H 5/10

[52] U.S. Cl. ..... 271/12; 271/100

[58] Field of Search ..... 271/6, 11, 12, 99, 100

[56] References Cited

U.S. PATENT DOCUMENTS

| | | | |
|---|---|---|---|
| 1,806,102 | 11/1932 | Jahne | 271/100 |
| 3,497,205 | 2/1970 | Harrison | 271/100 |
| 4,155,546 | 5/1979 | Jacobs | 271/100 |
| 4,369,962 | 1/1983 | Spiro | 271/100 |
| 4,484,735 | 11/1984 | Goi | 271/12 |

FOREIGN PATENT DOCUMENTS

| | | | |
|---|---|---|---|
| 24307 | of 1914 | United Kingdom | 271/100 |
| 665512 | 1/1952 | United Kingdom | 271/12 |
| 829518 | 3/1960 | United Kingdom | 271/100 |

*Primary Examiner*—Robert P. Olszewski
*Assistant Examiner*—Steven M. Reiss
*Attorney, Agent, or Firm*—Hedman, Gibson & Costigan

[57] ABSTRACT

A centrally controlled automatic device for feeding single sheets or the like in a machine for packaging signatures, newspapers or the like in a continuous film of thermoplastic material, comprising a frame, container for containing sheets stacked one on the other for feeding, a separator for separating at least one sheet from the bottom of the container, an extractor for extracting at least one sheet separated by the separator, and an evacuator for evacuating at least one sheet once extracted, wherein the extractor consists of a lower conveyor band on which a presser roller is caused to engage with rocking movement, the rocking movement being provided by a first cam mechanism which causes the pressure roller to move from a first detached position to a second position of engagement with the lower conveyor band as soon as the separator has gripped an initial portion of the sheet and moved it from the bottom of the container onto the lower conveyor band, there also being provided a second cam mechanism arranged coaxially to the first cam mechanism to operate the separator, the cam mechanism being driven by single central drive shaft, which rotates the extractor.

5 Claims, 2 Drawing Sheets

CENTRALLY CONTROLLED AUTOMATIC DEVICE FOR FEEDING SINGLE SHEETS OR THE LIKE WITHIN A PACKAGING MACHINE

This invention relates to a centrally controlled automatic device for feeding single sheets or the like within a packaging machine. In known machines for packaging signatures, newspapers or the like in a continuous film or thermoplastic material, it is known to provide automatic devices for feeding single sheets or the like, which withdraw the single sheet from a container and feed it onto the continuous film of thermoplastic material, for example unwinding from a reel.

Known sheet feeding devices are provided with means which separate one of the sheets disposed in the container, in particular that close to its base, and means which extract said sheet from the container and feed it onto a conveyor band which transfers it onto the continuous film. Said separation means are generally sucker devices, while the extraction means are grippers which grip the end portion of the sheet and pull it ot move it onto the conveyor band.

However, said grippers have difficulty in correctly gripping the sheet in phase with the speed of operation of the packaging machine. They can also tear the sheet due to incorrect gripping, or from drag marks or impressions at the gripping points.

Moreover, because of their constructional complexity, they can also cause phasing problems for their constituent elements and are consequently subject to inconstant and imperfect operation.

An object of the present invention is to provide an automatic sheet feed device in which said extraction means are such as to overcome all the problems of synchronization and possible product damage inherent in known packaging machines.

A further object is to provide a device with a single central drive for it and for all the further means which cooperate in its correct operation.

These objects are attained according to the present invention by a centrally controlled automatic device for feeding single sheets or the like in a machine for packaging signatures, newspapers or the like in a continuous film of thermoplastic material, comprising a frame, means for containing sheets stacked one on the other for feeding, means for separating at least one of said sheets from the bottom of said container means, means for extracting said at leas one sheet separated by said separation means, and means for evacuating said at least one sheet once extracted, characterised in that said extraction means consist of a lower conveyor band on which a presser roller is caused to engage with rocking movement, said rocking movement being provided by a first cam mechanism which causes the presser roller to move from a first detached position to a second position of engagement with said lower conveyor band as soon as said separation means have gripped an initial portion of said a least one sheet and moved it from the bottom of said container means onto said lower conveyor band, there also being provided a second cam mechanism arranged coaxially to said first cam mechanism to perate said separation means, said cam mechanisms being driven by a single central drive shaft, which rotates said extraction means.

In a preferred embodiment the conveyor band consists of a series of parallel accompanying belts which cooperate with at least one pair of drums of diameter greater than the support for the belts, so that advantageously the presser roller enters into engagement only with the pair of drums when the sheet withdrawn from the container means is interposed, so ensuring reliable operation in perfect synchronism with and preventing any damage to the gripped and extracted sheet.

The structural and operational characteristics and advantages of a device according to the present invention will be more apparent from the description given hereinafter by way of non-limiting example with reference to the accompanying schematic drawings, in which.

Figure 1:
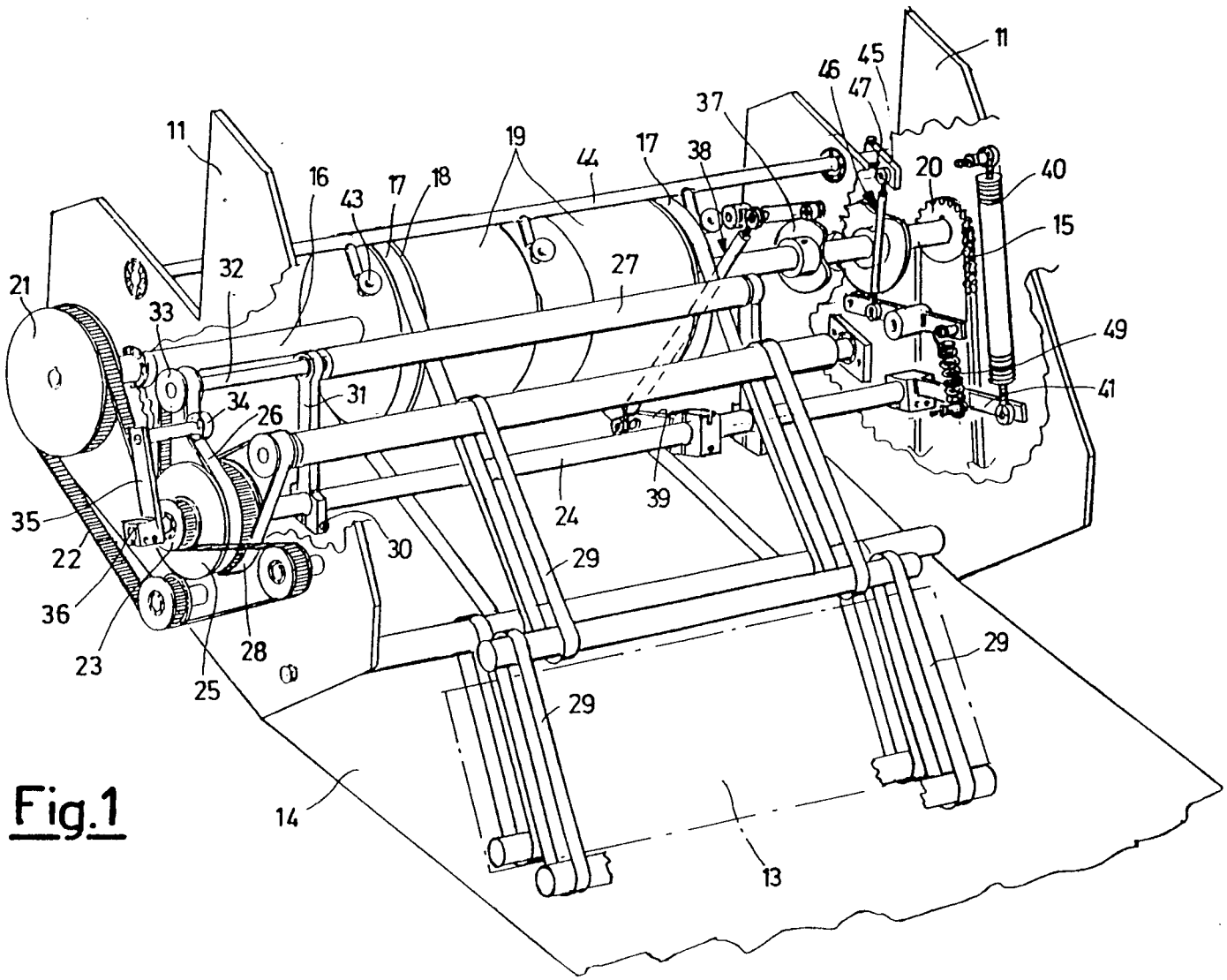
FIG. 1 is perspective view of the automatic feed device of the present invetnion, inwhich the container means for the sheets to be fed and portions of the device shoulders have been omitted.
Figure 2:
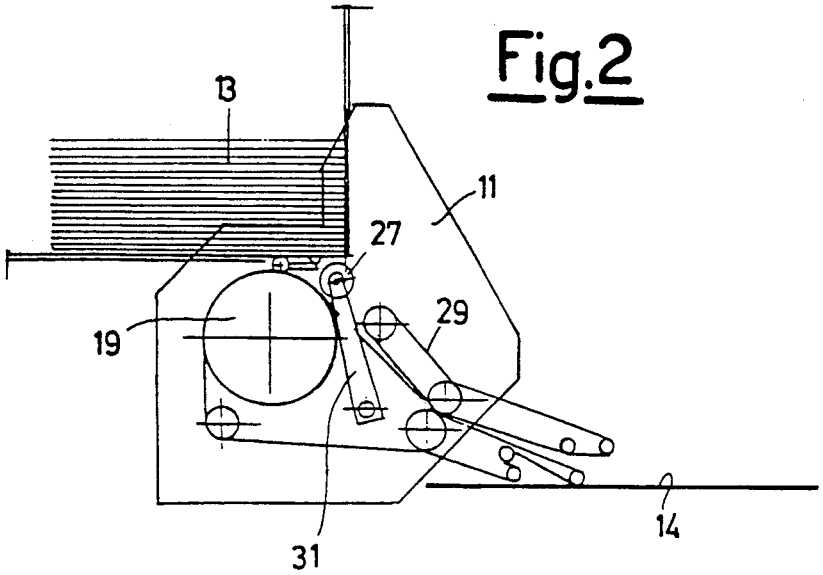
FIG. 2 is an elevational view within a shoulder showing schematically the path of the belts, the drums associated with them and the presser roller which cooperates with them.

In a packaging machine for signatures, newspapers or the like there is usually provided, particularly at its front, an automatic device for feeding single sheets or the like to be packaged in a continuous film of thermoplastic material, which is fed for example from a reel.

An automatic feed device of the type according to the present invetnion is shown in the figures, in which all parts in common with known devices are omitted or shown only schematically. The automatic feed device for single shets according to eh invetnion comprises essentially a series of means arranged in a particular combination. Essentially they comprise means for containing the sheets stacked one on the other for feeding, means for separating at least one of said sheets from the bottom of the container means, for extracting at least one sheet separated by the separation means, and finally means for evacuating the sheet.

More specifically, the illustrated device omprises essentially a frame, represented schematically by the pair of shoulders 11, on the top of which a container means indicated overall by 12 is disposed, in which single sheets 13 or the like are stacked one on the other. In the lower part opposite the container means 12 there is an exit table represeted schematically by 14 and consisting for example of a conveyor (not shown) on which a continuous film of thermoplastic material (also not shown) is fed, to be used for the packaging.

A central drive means (not shown), of which only a motion transmission chain 15 deriving from it is shown, provides for the entire movement of all the parts of the device according to the invention. More precisely, the chain 15, engaged about a sprocket 20, rotates a central drive shaft 16 on which the sprocket 20 is keyed an which is supported between the shoulders 11 to firstly rotate a lower conveyor band consisting essentially of a first series of belts 17. In the illustrated example two belts 17 are shown purely by way of example and to allow better understanding of the drawing, but are usually more numerous. The belts 17 accompany each other spaced apart and parallel, and in their initial portion are positioned essentially below the container means 12.

the belts 17 pass within recesses 18 provided in a pair of drums 19 rigid coaxially with the central drive shaft 16. In this manner the drums 19, which are of greater diameter than the recesses 18 and the portions of the belts 17 contained within them, enter into engagement with a presser roller 27 which is described in detail hereinafter.

Beyond the region in which it is supported by that shoulder 11 opposite the one at which it receives its rotary motion, the drive shaft 16 carries a composite belt transmission by which it rotates a series of means which constitute the device of the invention. In this respect, a first toothed pulley 21 keyed onto the drive shaft 16 rotates a belt 2 provided with theeth on both its surfaces. The teeth on the outer surface of the belt 22 engage a second pulley 23 provided on a second shaft 24 and free to rotate on interposed bearings. The second pulley 23 is rigidly connected to a third pulley 25 of greater diameter, which is also free to rotate on interposed bearings and with which there engage a second toothed belt 26 to rotate a presser roller 27 and a third toothed belt 28 rotate an upper presser band consisting of a second series of belts 29.

The presser roller 27 and the first series of belts 17 essentially form the said extraction means for the sheet 13, the presence of the drums 19 completing or improving said extraction means in a preferred embodiment such as that described.

The second series of belts 29 in cooperation with the terminal portion of the first series of belts 17 form said evacuation means for the sheet 13.

It can be seen that a pair of levers 31 supporting the presser roller 27 are fixed on the second shaft 24 by end clamps 30. It can also be seen that an extension of one end of a shaft 32 connected to the roller 27 carries a further toothed pulley 33 which receives its motion from the second toothed belt 26, to rotate the roller 27. Because of the particular arrangement and rocking motion of the presser roller 27 which is explained hereinafter, the second toothed belt 26 is provided with a rotary tensioning device 34 rotattably supported on a right-angled lever 35 rigidly secured to one end of the second shaft 24 by a locking clamp 36.

The device according to the invention is provided with a first cam mechanism which causes the presser roller to move from a first position detached from the first series of belts 17 or rather from the drums 19 to a second position in engagement with them. This first cam mechanism consists essentially of a first cam 37 keyed onto the drive shaft 16 and on which an elastically yieldable articlated lever system 38 acts to transform the rotational motion of the cam inot rocking motion of an end lever 39 locked on the second shaft 24. In this manner the second shaft 24 is subjected to a rocking movement which is consequently transmitted to the presser roller 27 supported on it.

An elastic element such as a spring 40 is secured at one end to the shoulder 11 and at its other end to a free end of a further lever 41 rigid with the free end of the second shaft 24. The spring 40 therefore exerts traction on the lever 41 which by rotating the second shaft 24 urges the presser roller in the direction against the first series of belts 17, i.e. against the drums 19.

The device of the invention is also provided with means for separating the sheets 13 from the bottom of the container means 12. More specifically, in a position corresponding with an aperture 42 provided in the base of the container means 12 there is a serries of sucker elements 43 supported on a third shaft 44 arranged transverse to the shoulders 11 and caused to rock by a second cam machinism provided at one end.

The structure and operation of the sucker elements is of known type, and the second cam mechanism comprises a second cam 45 keyed onto the drive shaft 16, and on which a further elastically yieldable articulated lever 46 system acts to transform the rotational motion into rocking motion of an end lever 47 locked on the third shaft 44. In this manner the third shaft is subjected to a rocking movement which causes the sucker elements 43 to move from a first retracted position below the conveyor band, i.e. below the frirst serires of belts and bleow the outer surface of the drums, to a second position corresponding with the aperture 42 of the container means where they engage an initial portion of the sheet 13. Again in this case an elastic element such as a spring 48 is provided suitably secured at one end to the soulder and at its other end to a further lever 49 of the articulated lever system 46 to ensure engagement of the sucker elements on the initial portion of the sheet 13.

The operation of an automatic device according to the invention is to some extent apparent from the aforegoing description, but can be summarized as follows with particular reference to the diagrams of FIGS. 3 to 5.

Figure 3:
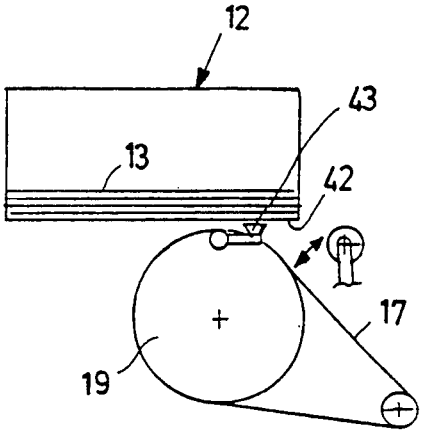
FIGS. 3, 4 and 5 are operating diagrams of the device of the present invention showing successive operating stages.

Thus in a first stage the two cam mechanisms 37, 38 and 45, 46 determine the position shown in FIG. 3 in which the presser roler 27 is raised from the belts 17 and drums 19, and the suckers 43 are in contact with an initial portion of a sheet 13 at the aperture 42 in the container means 12.

Figure 4:
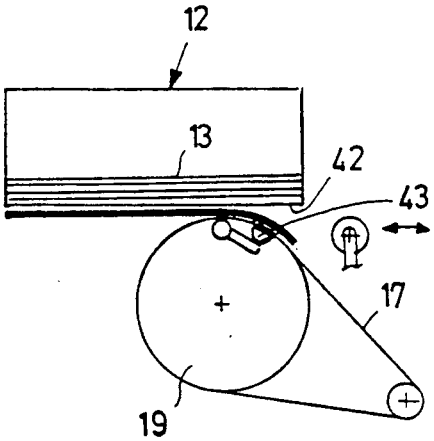
Figure 5:
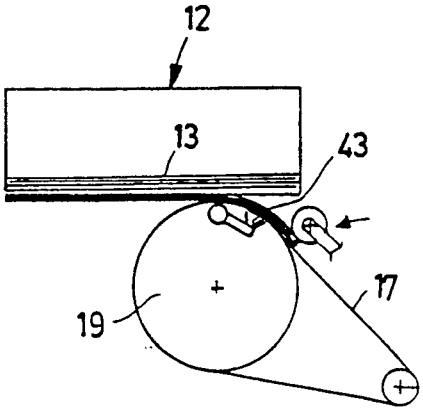

As the rotation of the second cam mechanism 45, 46 continues the suckers 43 rotate clockwise to drag the initial portion of the sheet 13 onto the drums 19 and belts 17 (FIG.4). It is only at this point that the first cam mechanism 37, 38 causes the presser roller to swing onto the initial portion of the sheet 13 to retain it between the presser roller and the outer surfaces of the drums 19 (FIG.5).

At this point the suckers 43 disengage in known manner to allow the further rotation of the central drive shaft 16 to advance the sheet 13, which being supported only at the exit of the drums 19 on the belts 17 moves unitl it becomes inserted between the belts 17 and the belts 29 of the upper presser band.

The cycle then continues with the further extraction of a sheet and its further feed onto the continuous film of thermoplastic material of the packaging machine.

The particular structure of th cetrally controlled automatic feed device of the present invention and its positive movement transmission ensure perfect synchronism between the various speeds by proper choice of the toothed pulley dimensions and cam contours based on the various transmission ratios required. This type of transmission also ensures correct transmission of rotation to the presser roller by virtue of having provided a rotary tensioning device which rocks rigidly with the rocking of the second drive shaft supporting the presser roller and which consequently maintains correct tensioning of the toothed belt in the various positions.

The particular structure of the extraction means formed form the presser roller and the lower conveyor band and the further presence of the drums ensure reliable extraction of the sheet previously separated from the container means, and at the same time prevents any damage to the sheet.

We claim:

1. A centrally controlled automatic device for feeding single sheets or the like in a machine for packaging signatures or newspapers in a continuous film of thermoplastic material, comprising:

(a) a frame, (b) means for containing sheets stacked one on the other for feeding, (c) means for separating at least one of said sheets from teh bottom of said container means, (d) means for extracting said at least one sheet separated by said separation means and (e) means for evacuating said sheet once extracted, said extraction means consists of a lower conveyor band on which a presser roller is caused to engage with rocking movement, said rocking movement being provided by a first cam machanism which causes the presser roller to move from a first detached position to a second of engagement with said lower conveyor band as soon as said spearation means have gripped an initial portion of said sheet an dmoved it from the bottom of said container means on to said lower conveyor band, there also being provided a second cam mechanism arranged coaxially to said frist cam mechanism to operate said separation means, said cam mechanisms being driven by a single central drive shaft which rotates said extraction means and said lower conveyor band consists essentially of a series of spaced-apart parallel belts, within an initial portion of which, disposed essentially below said container means, there being provided interposed with said series of belts at least one pair of drums having a greater diameter than the drums on which the belts are supported, so that said presser roller enters into engagement only with said pair of drums with said initial portion of said sheet interposed.

2. A device as claimed in claim 1, characterised in that said evacuation means comprise an end portion of said lower conveyor band associated with an upper presser belt which is rotated synchronously with said lower conveyor band by a further transmission operationally connected in a positive manner to said central drive shaft.

3. A device as claimed in claim 1, characterised in that the presser roller is positioned on levers which rock about a second shaft, rigid with which there is provided a second lever carrying a rotary tensioning device for a presser roller drive belt which rotates said presser roller at a peripheral speed synchronous with the speed of advancement of said lower conveyor band.

4. A device as claimed in claim 3, characterised in that with said frist cam mechanism there is associated an elastic element which normally urges said presser roller in a direction against said lower conveyor band.

5. A device as claimed in claim 1, characterised in that said first and second cam machanism comprise a cam keyed onto the central drive shaft and interacting with an articulated lever system which is elastically yieldable and is connected by an end lever to a second shaft supporting said presser roller and, respectively, to a third shaft supporting said separation means in the form of sucker elements.

* * * * *